US011272777B2

(12) United States Patent
Giron et al.

(10) Patent No.: US 11,272,777 B2
(45) Date of Patent: Mar. 15, 2022

(54) TRANSFER DEVICE FOR MAKING UP KERATIN MATERIALS

(71) Applicant: L'OREAL, Paris (FR)

(72) Inventors: Franck Giron, Lagny sur Marne (FR); Henri Samain, Bievres (FR)

(73) Assignee: L'OREAL, Paris (FR)

( * ) Notice: Subject to any disclaimer, the term of this patent is extended or adjusted under 35 U.S.C. 154(b) by 564 days.

(21) Appl. No.: 15/108,305

(22) PCT Filed: Dec. 19, 2014

(86) PCT No.: PCT/IB2014/067130
§ 371 (c)(1),
(2) Date: Jun. 26, 2016

(87) PCT Pub. No.: WO2015/097613
PCT Pub. Date: Jul. 2, 2015

(65) Prior Publication Data

US 2016/0316892 A1 Nov. 3, 2016

(30) Foreign Application Priority Data

Dec. 27, 2013 (FR) ..... 1363639

(51) Int. Cl.
*A45D 40/30* (2006.01)
*B41M 5/025* (2006.01)
(Continued)

(52) U.S. Cl.
CPC ..... *A45D 40/30* (2013.01); *B41J 2/0057* (2013.01); *B41M 5/0256* (2013.01); *B44C 1/16* (2013.01);
(Continued)

(58) Field of Classification Search
CPC .. A45D 40/30; A45D 40/0087; A45D 44/002; A45D 29/001; A45D 33/38; A45D 2029/005; A45D 2029/008; B41J 3/28
(Continued)

(56) References Cited

U.S. PATENT DOCUMENTS 2,746,460 A 5/1956 Jellinek
4,137,180 A 1/1979 Naik et al.
(Continued)

FOREIGN PATENT DOCUMENTS

CN 1476319 A 2/2004
CN 1519278 A 8/2004
(Continued)

OTHER PUBLICATIONS

Non-Final Office Action for U.S. Appl. No. 15/108,294 dated Mar. 4, 2019 (11 pgs.).
(Continued)

*Primary Examiner* — Tatiana L Nobrega
*Assistant Examiner* — Sarah Woodhouse
(74) *Attorney, Agent, or Firm* — Shumaker, Loop & Kendrick, LLP

(57) ABSTRACT

A process for making up an area of human keratin materials using a makeup device including a deformable substrate bearing a transfer surface intended to come into contact with the keratin materials and configured to receive a coat of cosmetic ink. The process includes the following steps: a. depositing at least one cosmetic ink onto the transfer surface by a digital printer, b. placing the transfer surface in contact with the area to be made up by mechanical action, especially by exerting a pressure on a surface opposite the transfer surface, and c. moving the transfer surface away from the area of the human keratin materials after the ink has been transferred.

6 Claims, 4 Drawing Sheets

Figures 1A, 1B, 1C:
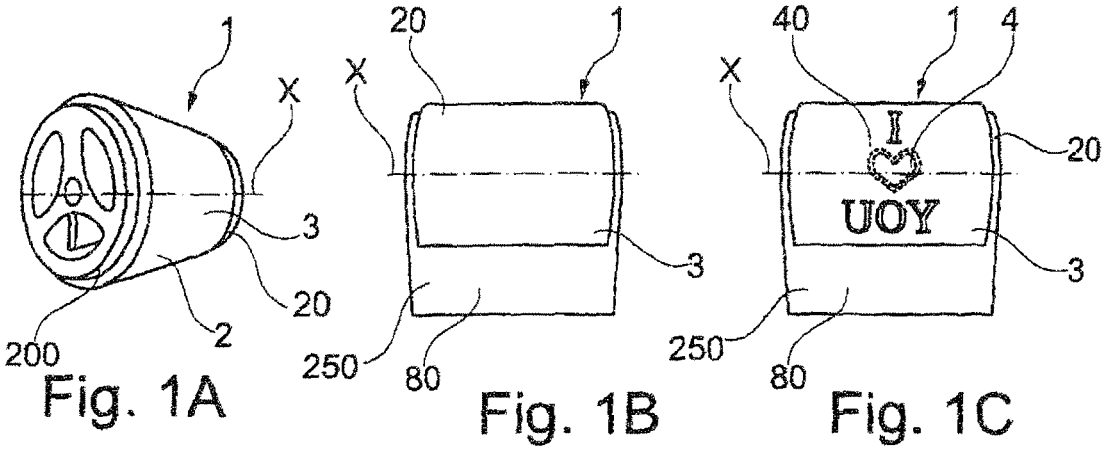

(51) Int. Cl.
*B44C 1/16* (2006.01)
*B41J 2/005* (2006.01)
*G03G 13/04* (2006.01)

(52) U.S. Cl.
CPC ..... *G03G 13/04* (2013.01); *B41M 2205/10* (2013.01)

(58) Field of Classification Search
USPC ..... 132/200, 285, 319, 320; 604/303
See application file for complete search history.

(56) References Cited

U.S. PATENT DOCUMENTS 4,804,719 A 2/1989 Weaver et al.
4,874,554 A 10/1989 Lange et al.
4,903,840 A 2/1990 So
4,925,667 A 5/1990 Fellows et al.
4,936,325 A 6/1990 Davis
4,999,418 A 3/1991 Krutak et al.
5,030,708 A 7/1991 Krutak et al.
5,032,670 A 7/1991 Parham et al.
5,043,376 A 8/1991 Sharma et al.
5,047,084 A 9/1991 Miller et al.
5,078,160 A 1/1992 Carbonnier
5,102,980 A 4/1992 Krutak et al.
5,104,913 A 4/1992 Sharma et al.
5,106,942 A 4/1992 Krutak et al.
5,194,463 A 3/1993 Krutak et al.
5,281,659 A 1/1994 Weaver et al.
5,396,913 A 3/1995 Wallschlaeger
5,421,765 A 6/1995 Lehmann et al.
5,913,315 A * 6/1999 Todd ..... A45D 2/40 132/206
5,958,560 A 9/1999 Ewan
5,997,134 A 12/1999 Hotomi et al.
5,997,136 A 12/1999 Fujisawa et al.
6,013,248 A 1/2000 Luebbe et al.
6,106,852 A 8/2000 Vineberg
6,168,656 B1 1/2001 Schulz et al.
6,190,730 B1 2/2001 Matsos et al.
6,299,967 B1 10/2001 Collins et al.
6,312,124 B1 11/2001 Desormeaux
6,342,094 B1 1/2002 Kabalnov
6,367,484 B1 4/2002 Ramin et al.
6,428,164 B1 8/2002 Missell et al.
6,543,893 B2 4/2003 Desormeaux
6,622,733 B2 9/2003 Saksa
6,626,183 B1 * 9/2003 Pietrocola ..... A45D 29/001 132/73
7,241,503 B2 7/2007 Noguchi
7,648,364 B2 1/2010 Dauga et al.
8,007,062 B2 8/2011 Edgar et al.
8,083,422 B1 12/2011 Simmons
8,545,613 B2 10/2013 Blette
8,695,610 B2 4/2014 Samain
9,526,315 B2 * 12/2016 Shinoda ..... A45D 40/261
9,616,668 B1 4/2017 Rabe
2002/0020422 A1 2/2002 Iosilevich
2002/0035182 A1 3/2002 L'Alloret et al.
2002/0061321 A1 5/2002 Bara
2002/0110672 A1 8/2002 Muratore-Pallatino et al.
2002/0155069 A1 10/2002 Pruche
2002/0164295 A1 11/2002 Scavone et al.
2003/0053976 A1 3/2003 Tournilhac et al.
2004/0057742 A1 3/2004 Richtsmeier
2004/0078278 A1 4/2004 Dauga
2004/0241423 A1 12/2004 Ramin et al.
2004/0246327 A1 12/2004 Elzi
2005/0036813 A1 * 2/2005 Sim ..... G07F 17/26 400/323
2005/0148908 A1 7/2005 Stover
2006/0093943 A1 5/2006 Shu et al.
2006/0098076 A1 5/2006 Liang
2006/0150994 A1 7/2006 Pilmanis
2007/0144634 A1 6/2007 Hitchcock
2008/0031836 A1 2/2008 Ilekti
2008/0053476 A1 * 3/2008 LaHood ..... A45D 33/38 132/320
2008/0152681 A1 6/2008 Brown et al.
2008/0176160 A1 7/2008 Deprez et al.
2009/0325221 A1 12/2009 Long et al.
2010/0031834 A1 2/2010 Morgavi et al.
2010/0068247 A1 3/2010 Mou et al.
2010/0086693 A1 4/2010 Yamada et al.
2011/0020023 A1 1/2011 Hirai
2011/0025040 A1 2/2011 Dominguez
2011/0123703 A1 5/2011 Mohammadi et al.
2011/0141188 A1 6/2011 Morita
2011/0159463 A1 6/2011 Samain
2011/0164263 A1 7/2011 Samain et al.
2011/0268873 A1 11/2011 Blette
2012/0027423 A1 2/2012 Kawai
2012/0029417 A1 2/2012 Samain et al.
2012/0064011 A1 3/2012 Schumann
2012/0192884 A1 * 8/2012 Nasu ..... A45F 3/18 132/200
2012/0244316 A1 9/2012 Dobler et al.
2012/0244465 A1 9/2012 Kobayashi
2012/0307304 A1 12/2012 Moreno
2013/0216295 A1 * 8/2013 Wong ..... A45D 44/005 401/195
2014/0233967 A1 8/2014 Suzuki
2015/0053759 A1 2/2015 Cahill et al.
2015/0150767 A1 6/2015 Klug et al.
2016/0000208 A1 * 1/2016 Wong ..... A45D 44/002 132/320
2016/0103962 A1 4/2016 Costantino et al.
2016/0316890 A1 11/2016 Samain
2016/0316891 A1 11/2016 Samain
2016/0317403 A1 11/2016 Giron
2016/0324298 A1 11/2016 Samain
2016/0324299 A1 11/2016 Samain
2019/0133300 A1 5/2019 Hedglin

FOREIGN PATENT DOCUMENTS

CN 101010064 A 8/2007
CN 101056605 A 10/2007
CN 101686927 A 3/2010
CN 101980694 A 2/2011
CN 102490540 A 6/2012
DE 102005050123 A1 4/2007
EP 705593 A1 4/1996
EP 0728460 A1 8/1996
EP 0749746 A1 12/1996
EP 0749747 A1 12/1996
EP 780114 A1 6/1997
EP 0923928 A1 6/1999
EP 0930060 A1 7/1999
EP 0938887 A1 9/1999
EP 1000607 A1 5/2000
EP 1048282 A1 11/2000
EP 1059047 A1 12/2000
EP 1304056 A2 4/2003
EP 1925278 A1 5/2008
EP 2090935 A1 8/2009
FR 2232303 A1 1/1975
FR 2759941 A1 8/1998
FR 2792192 A1 10/2000
FR 2858226 A1 2/2005
FR 2900594 A 8/2007
FR 2905630 A1 3/2008
FR 2909844 A1 6/2008
FR 2939033 A1 6/2010
JP S62180000 A 8/1987
JP S63-188616 A 8/1988
JP H-2503065 A 9/1990
JP H04-208997 A 7/1992
JP H11169231 A * 12/1997
JP H11-007203 A 1/1999
JP H11-169231 A 6/1999
JP H-11169231 A 6/1999

(56) References Cited

FOREIGN PATENT DOCUMENTS

| | | | |
|---|---|---|---|
| JP | H11169231 | A | 6/1999 |
| JP | H11-346828 | A | 12/1999 |
| JP | 2001-245945 | A | 9/2001 |
| JP | 2001278739 | A | 10/2001 |
| JP | 3266197 | B2 | 1/2002 |
| JP | 2002-058528 | A | 2/2002 |
| JP | 2002068935 | A | 3/2002 |
| JP | 2002-148998 | A | 5/2002 |
| JP | 2003006452 | A | 1/2003 |
| JP | 2004501177 | A | 1/2004 |
| JP | 2004262913 | A | 9/2004 |
| JP | 2005040356 | A | 2/2005 |
| JP | 2005-088434 | A | 4/2005 |
| JP | 2007204487 | A | 8/2007 |
| JP | 2008-127388 | A | 6/2008 |
| JP | 2010505843 | A | 2/2010 |
| JP | 2010-186133 | A | 8/2010 |
| JP | 2012-002869 | A | 1/2012 |
| JP | 2012502908 | A | 2/2012 |
| JP | 2012072081 | A | 4/2012 |
| JP | 2012-518457 | A | 8/2012 |
| JP | 2012518457 | A | 8/2012 |
| JP | 2012-520837 | A | 9/2012 |
| JP | 2012249849 | A | 12/2012 |
| JP | 2013-031504 | A | 2/2013 |
| JP | 2013137758 | A | 7/2013 |
| JP | 2013532003 | A | 8/2013 |
| JP | 2013-252709 | A | 12/2013 |
| WO | 1992007913 | A1 | 5/1992 |
| WO | 9848659 | A1 | 11/1998 |
| WO | 02/36083 | A1 | 5/2002 |
| WO | 03033270 | A1 | 4/2003 |
| WO | 2006/128737 | A1 | 12/2006 |
| WO | 2006128737 | A1 | 12/2006 |
| WO | 2007/134171 | A1 | 11/2007 |
| WO | 2010/004526 | A1 | 1/2010 |
| WO | 2010004526 | A1 | 1/2010 |
| WO | 2010004531 | A1 | 1/2010 |
| WO | 2010/095118 | A | 8/2010 |
| WO | 2010/105842 | A2 | 9/2010 |
| WO | 2012081065 | A1 | 6/2012 |
| WO | 2013093889 | A2 | 6/2013 |
| WO | 2013126513 | A1 | 8/2013 |
| WO | 2013178701 | A2 | 12/2013 |

OTHER PUBLICATIONS

Office Action dated Apr. 23, 2018 in European Patent Application No. 14 833 256.2.
Office Action dated Jul. 2, 2018 issued in Japanese Patent Application No. 2016-543073 (17pp).
Office Action dated Jun. 5, 2018 issued in Chinese Patent Application No. 201480074439.7 (16 pp).
Office Action dated Sep. 10, 2018 in Japanese Patent Application No. 2016-542897 (7 pages).
Office Action dated Sep. 27, 2018 in U.S. Appl. No. 15/108,292 (16 pages).
Pubchem; castor oil—https://pubchem.ncbi.nlm.nih.gov/compound/castor_oil#section=Top; 1 page; 2010.
Office Action issued in Chinese Application No. 201480071272.9 dated Jul. 2, 2018 (14 pp).
Office Action issued in U.S. Appl. No. 15/108,295 dated Aug. 6, 2018 (56 pp).
Office Action issued in U.S. Appl. No. 15/108,151 dated Aug. 7, 2018 (60 pp).
Office Action for JP App. No. 2016-543027 dated Dec. 21, 2018 with English Translation (13 pages).
Office Action for JP App. No. 2016-543057 dated Dec. 17, 2018 with English Translation (14 pages).
Final Rejection for U.S. Appl. No. 15/108,076 dated Aug. 21, 2017.
Canon, fix your own printer, https://www.fixyourownprinter.com/posts/66407 (dated: Mar. 17, 2010) (1 page).
Final Rejection for U.S. Appl. No. 15/108, 292 dated Apr. 26, 2019 (7 pages).
Office Action for JP App. No. 2016-543072 dated Dec. 17, 2018 with English Translation(7 pages).
Office Action for JP App. No. 2016-543056 dated Dec. 17, 2018 with English Translation (7 pages).
First Office Action for CN Pat. Appln. No. 201480076509.2 with English Translation dated Oct. 30, 2017, 9 pages.
Final Rejection for U.S. Appl. No. 15/108,292 dated Jan. 30, 2018, 21 pages.
Apr. 12, 2018 Office Action issued in U.S. Appl. No. 15/108,303.
Non-Final Office Action in U.S. Pat. U.S. Appl. No. 15/108,192 dated Oct. 6, 2017 (6 pages).
Office Action dated May 18, 2018 for Chinese Patent Application No. 2014800713416 (22 pages).
Dyno Pretty Pup: "Dyno Pretty Pup Beauty Diary: LA Colors 30 Eye Design Palettes—Review." Mar. 16, 2012 (4 pages).
Written Opinion for PCT/IB2014/067130 (7 pages).
Restriction Requirement for U.S. Appl. No. 15/108,303 dated Sep. 6, 2017 (7 pages).
Final Rejection for U.S. Appl. No. 15/108,302 dated Jul. 2, 2019 (7 pages).
Notice of Allowance for U.S. Appl. No. 15/108,294 dated Jul. 25, 2019 (9 pages).
Japanese Office Action for JP Pat. Appln. No. 2016-543057 dated Aug. 26, 2019 (8 pages).
Notice of Allowance for U.S. Appl. No. 15/108,292 dated Aug. 29, 2019 (16 pages).
Japanese Office Action for JP Pat. Appln. No. 2016-543056 dated Aug. 26, 2019 (8 pages).
Japanese Office Action for JP Pat. Appln. No. 2016-542996 dated Sep. 2, 2019 (14 pages).
Final Rejection for U.S. Appl. No. 15/108,295 dated Jun. 15, 2020 (12 pages total).
Japanese Office Action for JP Pat. Appln. No. 2016-542897, dated Sep. 17, 2019 (10 pages).
Examiner's Answer in response to Appeal Brief filed Dec. 4, 2019 for U.S. Appl. No. 15/108,302, mailed Feb. 4, 2020 (7 pages).
Japanese Office Action for JP Patent App. No. 2016-543072 dated Mar. 12, 2020 with English translation (7 pages).
Non-Final Office Action for U.S. Appl. No. 15/108,151 dated Jul. 20, 2020 (10 pages).
Japanese Office Action for 2019-127617 dated Jun. 22, 2020 with English Translation (9 pages).
Non-Final Office Action for U.S. Appl. No. 15/108,295 mailed (15 pages).
Final Rejection for U.S. Appl. No. 15/108,151 dated Oct. 23, 2020 (8 pages).
Office Action for Korean Patent App. No. 10-2016-7020078 dated Jan. 27, 2021 with English Translation (14 pages).
Final Rejection for U.S. Appl. No. 15/108,295 dated Apr. 2, 2021 (18 pages).
Non-Final Office Action for U.S. Appl. No. 15/108,302 dated Apr. 22, 2021 (10 pages).
Restriction Requirement for U.S. Appl. No. 16/694,035, dated Jan. 12, 2021 (8 pgs.).
Patent Board Decision—Examienr Affirmed for U.S. Appl. No. 15/108,302, mailed Jan. 8, 2021 (10 pgs.).
Advisory Action for U.S. Appl. No. 15/108,151, dated Jan. 8, 2021 (3 pgs.).
Non-Final Office Action for U.S. Appl. No. 16/694,035 dated May 10, 2021 (7 pages).
Non-Final Office Action for U.S. Appl. No. 15/108,151 dated Feb. 25, 2021 (8 pages).
European Office Action for EP Pat. Appln. No. 14833254.7 dated Aug. 30, 2021 (5 pages).
Korean Office Action for KR Pat. Appln. No. 10-2016-7020687, dated Feb. 25, 2021 with English Translation (22 pages).
Corrected Notice of Allowance for U.S. Appl. No. 15/108,302 dated Sep. 8, 2021 (2 pages).
Notice of Allowance for U.S. Appl. No. 15/108,302 dated Aug. 23, 2021 (9 pages).

(56) References Cited

OTHER PUBLICATIONS

Supplemental Notice of Allowance for U.S. Appl. No. 15/108,295 dated Aug. 11, 2021 (6 pages).
Notice of Allowance for U.S. Appl. No. 15/108,295 dated Aug. 5, 2021 (10 pages).
International Search Report for PCT/IB2014/067130 dated Mar. 11, 2015 (5 pages).
International Search Report for PCT/IB2014/067132 dated Apr. 28, 2015 (4 pages).
International Search Report for PCT/IB2014/067133 dated Mar. 11, 2015 (5 pages).
International Search Report for PCT/IB2014/067134 dated Apr. 24, 2015 (4 pages).
International Search Report for PCT/IB2014/067136 dated Jul. 7, 2015 (5 pages).
International Search Report for PCT/IB2014/067138 dated Mar. 11, 2015 (3 pages).
Restriction and Election of Species Requirement in U.S. Appl. No. 15/108,292 dated Mar. 1, 2017 (8 pages).
Non-Final Office Action in U.S. Appl. No. 15/108,076 dated Mar. 16, 2017 (12 pages).
"Papilio Laser Printable Temporary Tattoo Paper" (http://www.papilio.com/laser temporary tattoo paper.html), Dec. 14, 2013 (3 pages).
"Cheap laser printer paper for toner transfer?" (http://www.fountainpennetwork.com/forum/topic/41250-cheap-laser-printer-paper-for-toner-transfer/), Oct. 2, 2007 (11 pages).
Non-Final Office Action for U.S. Appl. No. 15/108,292 dated Jul. 7, 2017.
Chinese Office Action dated Dec. 5, 2018 in Chinese Application No. 201480071307.9 (8 pages).
Japanese Office Action dated Nov. 19, 2018 for Japanese Application No. 2016-542996 (32 pages).
LA Colors 30 Eye Design Palettes—Review, Dyno Pretty Pup, http://dynopupbeauty.blogspot.n1/2012/03/la-colors-30-eye-design-palettes-review.html, Mar. 16, 2012 (5 pages).
Notice of Allowance dated Nov. 13, 2018 issued in U.S. Appl. No. 15/108,303 (27 pages).
Non-Final Office Action for U.S. Appl. No. 15/108,302 dated Feb. 8, 2019 (7 pages).
Final Rejection for U.S. Appl. No. 15/108,295 dated Feb. 5, 2019 (10 pages).
English Translation of JP Office Action for JP Pat. App. No. 2016-542995 drafted Jan. 16, 2019 and dated Jan. 21, 2019 (3 pages).
Final Rejection for U.S. Appl. No. 15/108,151 dated May 20, 2019 (11 pages).
Non-Final Office Action for U.S. Appl. No. 15/108,295 dated Jun. 6, 2019 (12 pages).
Non-Final Office Action for U.S. Appl. No. 15/108,151 dated Sep. 15, 2021 (10 pages).
Japanese Office Action for JP Pat. Appln. No. 2019-127617, drafted Aug. 12, 2021 and dated Sep. 6, 2021 with English Translation (11 pages).
Corrected Notice of Allowability for U.S. Appl. No. 15/108,302, dated Sep. 29, 2021 (2 pages).
Corrected Notice of Allowability for U.S. Appl. No. 15/108/302, dated Sep. 14, 2021 (2 pages).
Final Rejection issued for U.S. Appl. No. 16/694,035, dated Oct. 1, 2021 (11 pages).
Final Rejection for U.S. Appl. No. 15/108,151, dated Dec. 29, 2021 (8 pages).

* cited by examiner

TRANSFER DEVICE FOR MAKING UP KERATIN MATERIALS

BACKGROUND

It is difficult to make up keratin materials, especially the skin, by transferring a deposit of ink printed on a substrate. The reason for this is that the known inks are such that, once the printing is performed, they dry so quickly that transfer onto the keratin materials does not take place.

One way of solving this problem is to moisten the transfer surface or the area to be treated with a suitable solvent such as water. However, this method may be unacceptable due to the fact that it is not always possible to meter out precisely the amount of solvent to be applied, which may lead to "running" making the transfer onto the keratin materials irregular and/or imprecise and thus leading to an unsatisfactory makeup result.

Moreover, it is desirable to have available a makeup system that is capable of providing satisfactory transfer makeup in the case of a transfer performed immediately after printing, or within 30 minutes thereof, but also in the case of a transfer performed a few days or even a few months after printing.

In addition, it is also desirable for the pattern, once transferred onto keratin materials, especially the skin, to remain relatively stable. In other words, either immediately after transferring or, for example, within an hour of transferring, it is advantageous for the made-up area to be able to be touched, especially with the fingers, without deteriorating the pattern produced.

However, conventionally produced makeup coatings may not have satisfactory stability in this regard.

This lack of stability is not necessarily a problem if high precision of the makeup pattern is not sought. On the other hand, in the case of precise patterns obtained by printing, it is important for the makeup obtained after transferring to be stable.

Finally, it may also be advantageous for the user to be able to retouch the transferred pattern within minutes of transferring, for example so as to be able to soften the contour and to smooth out the demarcations with the area not made up.

There is consequently a need for a makeup process that allows transfer makeup to be performed by simple contact, without addition of solvent, whether the user seeks to transfer the pattern just after printing or after a longer or shorter period of storage of the device used.

It would also be advantageous to have available a transfer makeup device that allows the user, within minutes of transferring, to be able to retouch the pattern transferred onto the keratin materials, if necessary.

It is also desirable to have available a transfer makeup device that makes it possible to obtain a stable pattern within an hour of transferring.

Moreover, the surface of the human body has substantially flat areas such as the back, surfaces that have a generally cylindrical shape (arms and legs) and also hollows and domed parts, in particular the area of the eyes, the lips, the nose, the armpits, the feet, etc.

Now, transfer using the known systems is generally performed via flat transfer surfaces, for example printable plastic sheets, which have difficulty in adapting to the curved parts of the body. There is consequently a need for a transfer makeup device adapted to the various parts of the body, especially those bearing reliefs. For these parts, it is important for the pattern to be applied faithfully, following the skin relief.

The present invention is directed toward meeting all or some of these needs.

SUMMARY

According to a first of its aspects, the present invention relates to a process for making up an area of human keratin materials using a makeup device comprising a deformable substrate bearing a transfer surface, which is intended to receive a cosmetic ink and to come into contact with the keratin materials, the process comprising the following steps:

a. depositing a coat of at least one cosmetic ink onto the transfer surface by means of at least one digital printer,
b. placing the transfer surface in contact with the area to be made up by mechanical action, especially by exerting a pressure on a surface of the substrate opposite the transfer surface,
c. moving the transfer surface away from the area to be made up after the ink has been transferred.

The term "human keratin materials" denotes the skin, including the scalp, the lips, the nails, the hair, the eyelashes and the eyebrows; preferably the skin.

The term "digital printer" means a machine for printing in the form of pixels using digital data, different from a machine comprising a printing form. The use of at least one coat of cosmetic ink obtained by printing using a digital printer advantageously makes it possible to obtain great precision for a complex and customizable makeup. By means of the deformable substrate, the transfer surface adapts easily to the relief of the area to be made up. The flexible and deformable substrate makes it possible to obtain good transfer even on hollow or protruding areas of the body, in particular the area of the eyes, the lips, the nose, the armpits or the feet.

The invention advantageously makes it possible directly to print the coat of cosmetic ink onto a non-flat transfer surface, corresponding especially to the outer surface of a roller or pad, which facilitates the subsequent transfer onto areas of the body bearing reliefs. A roller is particularly advantageous for large areas, and pads are suitable for smaller areas.

Ink and Printed Pattern

Preferably, the ink is capable of transferring onto keratin materials without addition of an intermediary fluid compound, especially a liquid. In other words, the ink may transfer onto the keratin materials by simple contact of the area intended to be made up with the said ink, without it being necessary to apply an intermediary liquid intended to improve the transfer of the ink, as in the case of decal transfers.

The ink may be deposited onto the transfer surface by printing in the form of spots and/or of raster lines, so as to form a halftone image, for example a monochromatic or polychromatic image.

The pattern formed by printing on the transfer surface may be of any type. This pattern may reproduce the appearance of relief and/or colour heterogeneities of the skin, for example freckles or a mole.

The pattern formed on the transfer surface may be coloured when observed under white light in the visible region (400 nm-800 nm). As a variant, the pattern is colourless under white light in the visible region, but may appear coloured when submitted to a chemical and/or energy stimulus, such as exposure to UV (365 nm-400 nm), for example when the colouring ink contains a photochromic or fluorescent dyestuff.

The dyestuff may comprise one or more dyes as described below.

The dyestuff may be present in the ink in a mass content ranging from 0.01% to 60%, preferably ranging from 0.1% to 40%, or even from 0.1% to 30% and preferentially ranging from 0.5% to 20%, relative to the total mass of the ink.

The colouring ink may comprise one or more dyestuffs chosen from water-soluble dyes, liposoluble dyes, pulverulent dyestuffs such as pigments, especially nacres, and glitter flakes, or alternatively colouring polymers.

The term "pigments" should be understood as meaning white or coloured, mineral or organic particles of any form, which are insoluble in the cosmetic medium, and which are intended to colour the cosmetic ink.

The term "nacres" should be understood as meaning iridescent particles of any shape, in particular produced by certain molluscs in their shell, or else synthesized.

The pigments may be white, black or coloured, and mineral and/or organic. Among the mineral pigments that may be mentioned are titanium dioxide, optionally surface-treated, zirconium oxide or cerium oxide, and also zinc oxide, iron (black, yellow or red) oxide or chromium oxide, manganese violet, ultramarine blue, chromium hydrate and ferric blue, and metal powders, for instance aluminium powder and copper powder.

Among the organic pigments that may be mentioned are carbon black, pigments of D&C type and lakes based on cochineal carmine or on barium, strontium, calcium or aluminium.

The nacreous pigments may be chosen from white nacreous pigments such as mica coated with titanium or with bismuth oxychloride, coloured nacreous pigments such as titanium mica coated with iron oxides, titanium mica coated especially with ferric blue or with chromium oxide, titanium mica coated with an organic pigment and also nacreous pigments based on bismuth oxychloride.

Among the water-soluble dyes, mention may be made of the disodium salt of ponceau, the disodium salt of alizarin green, quinoline yellow, the trisodium salt of amaranth, the disodium salt of tartrazine, the monosodium salt of rhodamine, the disodium salt of fuchsin, xanthophyll and methylene blue.

Among the liposoluble dyes, mention may be made of Sudan Red III (CTFA: D&C Red 17), lutein, quinizarine green (CTFA: D&C Green 6), alizurol purple SS (CTFA: D&C Violet 2), Sudan Brown, D&C Yellow 11, D&C Orange 5, quinoline yellow, curcumin, and carotenoid derivatives such as lycopene, beta-carotene, bixin or capsanthin, and mixtures thereof. The colouring polymers are generally copolymers based on at least two different monomers, at least one of which is a monomeric organic dye. Such polymeric dyes are known to those skilled in the art. Reference may be made, for example, to the following documents: U.S. Pat. No. 5,032,670; U.S. Pat. No. 4,999,418; U.S. Pat. No. 5,106,942; U.S. Pat. No. 5,030,708; U.S. Pat. No. 5,102,980; U.S. Pat. No. 5,043,376; U.S. Pat. No. 5,104,913; U.S. Pat. No. 5,281,659; U.S. Pat. No. 5,194,463; U.S. Pat. No. 4,804,719; WO 92/07913 or EP 1 048 282.

The colouring ink may comprise one or more photochromic dyestuffs, especially pigments, i.e. dyestuffs which have the property of changing colour when they are irradiated with a light source of a certain frequency, and then of regaining their initial colour, or a similar colour, when the irradiation is stopped. Among the photochromic dyestuffs, mention may be made especially of:

- complex mineral photochromic compounds and more particularly doped aluminosilicates, and metal oxides and metal oxide hydrates, such as those described in WO-A-02/36083;
- photochromic naphthopyran compounds, especially 3H-naphtho[2,1-b]pyrans or 2H-naphtho[1,2-b]pyrans, for instance 3,3-bis(4-methoxyphenyl)-6-morpholino-3H-naphtho[2,1-b]pyran, 3-phenyl-3-(4-morpholinophenyl)-6-morpholino-3H-naphtho[2,1-b]pyran, 3-phenyl-3-(4-piperidinophenyl)-6-morpholino-3H-naphtho[2,1-b]pyran, 3-phenyl-3-(4-piperidinophenyl)-6-carboxymethyl-9-N-dimethyl-3H-naphtho[2,1-b]pyran or 2-phenyl-2-(4-piperidinophenyl)-5-carboxymethyl-9-N-dimethyl-2H-naphtho[1,2-b] pyran. Such compounds are described in patent application EP-A-1 410 785;
- diarylethene or fulgide compounds such as those described in patent application EP-A-938 887.

The colouring ink may also comprise one or more fillers, especially in a content ranging from 0.01% to 50% by weight, relative to the total weight of the colouring ink, preferably ranging from 0.01% to 30% by weight.

The term "fillers" should be understood as meaning colourless or white, mineral or synthetic particles of any shape, which are insoluble in the medium of the colouring ink, irrespective of the temperature at which this ink is manufactured.

These fillers serve especially to modify the rheology or texture of the colouring ink.

The fillers may be mineral or organic and of any shape, platelet-shaped, spherical or oblong, irrespective of the crystallographic form (for example lamellar, cubic, hexagonal, orthorhombic, etc.). Mention may be made of talc, mica, silica, kaolin, polyamide (Nylon®) powder (Orgasol® from Atochem), poly-β-alanine powder and polyethylene powder, tetrafluoroethylene polymer (Teflon®) powder, lauroyllysine, starch, boron nitride, hollow polymer microspheres such as polyvinylidene chloride/acrylonitrile microspheres, for instance Expancel® (Nobel Industrie), acrylic acid copolymer microspheres (Polytrap® from the company Dow Corning) and silicone resin microbeads (for example Tospearls® from Toshiba), elastomeric polyorganosiloxane particles, precipitated calcium carbonate, magnesium carbonate, magnesium hydrogen carbonate, hydroxyapatite, hollow silica microspheres (Silica Beads® from Maprecos), glass or ceramic microcapsules, and metal soaps derived from organic carboxylic acids containing from 8 to 22 carbon atoms and preferably from 12 to 18 carbon atoms, for example zinc stearate, magnesium stearate, lithium stearate, zinc laurate or magnesium myristate. The colouring ink may also comprise an additional polymer such as a film-forming polymer. The term "film-forming polymer" means a polymer that is capable of forming, by itself or in the presence of an auxiliary film-forming agent, a continuous film that adheres to a support, especially to keratin materials. Among the film-forming polymers that may be used in the colouring ink, mention may be made of synthetic polymers, of radical type or of polycondensate type, polymers of natural origin and mixtures thereof, in particular acrylic polymers, polyurethanes, polyesters, polyamides, polyureas, and cellulose-based polymers, for instance nitrocellulose.

Needless to say, a person skilled in the art will take care to select this or these optional additional compound(s), and/or the amount thereof, such that the advantageous properties of the colouring ink are not, or are not substantially, adversely affected by the envisaged addition.

The colouring ink may be in liquid or pulverulent form when borne by the transfer surface and before application to the keratin materials.

When it is fluid, the colouring ink has, for example, a viscosity ranging from 1 mPa·s to 500 mPa·s and preferably from 1 mPa·s to 300 mPa·s at 25° C.

The viscosity of an ink of the invention may be measured according to any process known to those skilled in the art, and especially according to the following conventional process. At 25° C. using a Rheomat 180 viscometer, equipped with a spindle rotating at 200 rpm, a person skilled in the art can select the spindle for measuring the viscosity from the spindles M1, M2, M3 and M4 on the basis of their general knowledge, so as to be able to perform the measurement.

The colouring ink may be in emulsion form.

When the ink is in the form of a cosmetic toner, this toner may comprise, besides the colouring agent, a compound for controlling the electrical charge, a particular additional filler, a lubricant, a wax and/or a binder.

Preferably, the particles of the toner have a mean size of between 1 and 16 μm. The toner comprises, for example, pigments with a particle size of between 1 and 10 μm.

In one particular embodiment, the ink is brought to a temperature of between 30° C. and 60° C. prior to its application to the substrate or the keratin materials, so as to fluidize it; the ink may be formulated to produce a solid material after printing and cooling to a temperature of 20° C.

The printing may use several different inks, especially inks of different colours.

The printing may use at least three, especially at least four, five, six, seven, eight, nine, ten, eleven or twelve colouring inks of different colours.

The printing may use only colouring inks that produce primary colours. As a variant, the printing uses both inks that produce primary colours and at least one colouring ink that produces a non-primary colour.

The printing of the colouring ink may be three-colour or four-colour printing. The pattern obtained by printing may comprise several areas of different colours. As a variant, the pattern obtained by printing is a flat tint. The colouring ink may be deposited in several printing passes. In other words, a first fraction of the colouring ink may first be printed onto the transfer surface, followed by a second fraction of the colouring ink on all or part of the first fraction.

The printing may also follow geometrical rectification rules. Insofar as the transfer surface is deformable, during the application the pattern may be geometrically deformed (for example extension in one of the two dimensions). As a result, the pattern is printed with a geometrical deformation (in the present case reduction according to the deformable dimension(s)) such that, after application, the pattern is at the desired scale. Geometrical rules: either universal or specific, may be applied to the pattern to be printed on the transfer surface so that the pattern has the desired form after transfer onto the area of the keratin materials to be treated. The use of such rectification rules is particularly advantageous with a substrate that has a transfer surface bearing reliefs, in particular in order to embrace the form of an imprint, as will be seen later. Use may be made in particular of specific geometrical rules adapted to the area to be treated and/or to the desired pattern.

In one embodiment, the substrate is coated with a coloured coating in dry form, the coating comprising a pigment and/or a dye, the colouring ink being printed onto the coating and an intermediary compound aiding the transfer then optionally being applied, for example an oil and/or a pressure-sensitive adhesive.

Substrate

The substrate is preferentially non-absorbent. The substrate is advantageously non-porous, at least on the transfer surface intended to receive the cosmetic ink.

The substrate comprises or consists of a deformable material, especially a thermoplastic and/or elastomeric deformable material.

Preferably, the substrate is elastically deformable. The substrate may be single-layered or multi-layered.

The substrate is advantageously compressible In order especially to increase its compressibility, the substrate may comprise one or more porous layers, especially at its core. The substrate may comprise a material incorporating alveolae or microspheres.

Preferably, the substrate is prepared such that, during the transfer of ink onto the keratin materials, the substrate is easily deformable by simple pressure exerted on the face opposite the transfer surface, which improves its contact with the keratin materials.

The transfer surface defines, for example, at least a portion of a cylinder or sphere. The transfer surface may be defined by all or part of: the outer surface of an applicator roller, a surface of an applicator pad, an element in sheet form, a patch, the surface of a porous foam, especially a sponge or a wipe. The transfer surface may be defined by a mixture of elastomers.

The transfer surface is defined, for example, by at least one elastomer chosen from the following non-limiting list: copolymerized butadiene-styrene, butadiene-nitrile and isobutylene-isoprene, copolymerized chloroethylene-polysulfide, polysulfides, EPDM (ethylene-propylene-diene monomer) or polyethylene-propylene diamine or polyurethanes.

The substrate comprises, for example, an elastomer, especially a silicone elastomer, for example VMQ or MQ, FVMQ, PVMQ (described in the publication by R. B. Simpson 2002, Rubber Basics, p. 96-ISBN 1-85957-307-X). An example of an elastomer that may be used is the one sold under the name Patsil® GEL 10 by the company Polytek.

The material defining the transfer surface may comprise at least one additional filler, a plasticizer (for example glycol ethers, phthalates or silicone oils), a colouring agent (pigment or dye), a protective agent for increasing the resistance to light (UV-screening agents), a vulcanizing agent and/or a vulcanization accelerator (sulfur, zinc oxide).

The additional compound(s) present in the material defining the transfer surface may in particular serve to improve the resistance to the oils and solvents present in the ink or used for cleaning the substrate.

The transfer surface may be brought into its final form by moulding (especially for crosslinkable materials), machining, laser machining, sintering, sanding, calendering a substrate, etc.

The transfer surface is preferably smooth and has a roughness of less than or equal to 1 mm and especially between 1 and 100 μm. The roughness is measured using a roughness meter, the tip of which has a radius of curvature of 10 mm, and the force of which, applied to the material to be characterized, is 6 mN.

The substrate may have a hardness of between 1 and 30 Shore A, preferably between 5 and 20 Shore A and more preferentially between 8 and 15 Shore A, for example equal to 10 Shore A, measured according to standard DIN 53 505, ISO/R868.

The thickness of the substrate may be adapted to the keratin materials to be made up.

The thickness of the substrate corresponds to its dimension measured perpendicular to the transfer surface. Depending on the position on the transfer surface, the thickness of the substrate may or may not be constant.

For example, when the colouring ink is intended to be applied to the cheeks and/or the nails, the substrate may have a thickness of between 1 mm and 3 mm, or even more than 3 mm.

In one embodiment example, the colouring ink is intended to be applied to the area around the eyes and/or to the lips, and the substrate has a thickness of between 3 mm and 1 cm, or even more than 1 cm.

In another embodiment example, the colouring ink is intended to be applied to the nose and/or in the area of the ears, and the substrate has a greater thickness, between 1 cm and 3 cm, or even more than 3 cm.

In one variant, the substrate is made in a "premoulded" form so as to facilitate its adaptation to the relief of the keratin materials, for example the negative of the lips or of the eye socket.

The substrate may be in the form of a printer's blanket, especially as used in the printing sector, comprising, in a known manner, a carcass for ensuring the mechanical performance qualities and a blanket layer, also known as a top, defining the transfer surface, and whose job is to provide the transfer performance qualities.

In one embodiment example, the substrate is at least partly covered with a coating, which may be coloured and which is itself capable of transferring onto the human keratin materials. The coating may be coloured a colour that is difficult to print, for example white or black, or a colour close to the flesh tone of the skin to be made up, such as a flesh colour. As a variant, the coating is not itself coloured.

The coating may comprise adjuvants for improving the transfer, such as oily substances, and/or for improving the persistence and/or for protecting the skin, such as sunscreens.

This or these coatings may also be applied to the substrate after it has been printed with the colouring ink.

In one embodiment example, the substrate comprises at least one translucent or transparent area.

The translucent or transparent area allows a user to see through the substrate and thus to visualize more easily the surface to be made up before transferring the colouring ink. The presence of a translucent or transparent area thus advantageously contributes towards facilitating the production of a precise makeup result.

The translucent or transparent area can be totally or partly superposed with the layer of colouring ink, and especially may overlap it.

The coat of colouring ink may be superposed in its entirety on the translucent or transparent area. As a variant, only part of the coat of colouring ink is superposed on the transparent area.

The substrate may be made entirely of a transparent or translucent material. In this case, the translucent or transparent area extends over the entire surface of the substrate.

In one embodiment example, the colouring ink is printed in a predefined pattern, the process comprising a step of choosing and/or making the pattern by a user and of transmitting, by means of a machine connected to at least one printer that performs the printing, information related to this pattern.

The machine may be a computer, an advanced mobile telephone, also known as a "smartphone", or a touch tablet. The machine may be connected physically and/or by means of a data exchange network to the said printer.

During the printing step a), the system may be at least partly assembled with the printer.

At least during step b) of placing the transfer surface in contact with the area to be made up, the substrate may bear on a support element of the system. During the printing, the substrate is supported, for example, by a removable substrate holder.

Support

The substrate can be attached, for the purpose of printing and/or of transfer onto the keratin materials, autonomously to a support, especially by friction, it being possible for the support to aid the handling of the substrate.

The substrate may embrace the form of the support.

The substrate may be bonded directly to the support, being, for example, self-adhesive. A self-adhesive substrate is in particular easy to handle, especially when its dimensions are relatively small.

The substrate may be tubular. It may or may not be symmetrical about a longitudinal axis.

The support may be cylindrical.

The support may be filled or hollow.

In one embodiment example, the substrate is plated onto the support, especially by means of its elastic properties.

The substrate may have been plated onto the support at the time of its attachment thereto. As a variant, the substrate is plated onto the support only during use, for example under the action of a negative pressure.

The support may have the form of a sphere or cylinder part, especially of a right cylinder. In one variant, the support has a flat surface onto which the substrate is plated.

The support may have a convex outer surface.

The support may have a concave outer surface, for example a developable surface that facilitates the plating of the substrate. In one variant, the support has the outer form of an hour glass, which is advantageous for plating a tubular substrate of variable thickness, which is thinner at the extremities and whose greater thickness at the centre facilitates application to body surfaces in relief The support may have the form of an applicator roller or a pad. A roller form facilitates uniform distribution of the pressure and uniform transfer of the pattern. It makes it possible to cover flat or rounded areas easily, such as the back, the tummy, the limbs or even the cheeks. The substrate may be deformed during the transfer under the effect of the force exerted by the roller on the face of the substrate opposite the transfer surface. The dimensions of the roller are adapted to the area to be made up and/or to the size of the desired patterns. The outside diameter of the roller is, for example, between 0.5 and 20 cm, or even between 1 and 10 cm. The width of the roller, measured parallel to its axis of rotation, is, for example, between 0.2 and 40 cm, or even between 10 and 200 mm. These dimensions are especially suited to making up the cheeks, the arms, the eyelids, the back, the ankles and the scalp.

Roller and Pad

According to another aspect, the present invention relates to a roller intended to be used on a printer according to the invention as described above, the roller bearing a deformable substrate defining the transfer surface, intended to receive an ink, especially a cosmetic ink, to be transferred by contact especially with the keratin materials, the transfer surface at least partly forming the outer surface of the roller.

The substrate may be attached to the roller by any suitable means known to those skilled in the art, especially by friction or bonding.

In one variant, the roller comprises means for attaching the substrate, especially at least one fixing clip or jaw.

The roller may also comprise a removable substrate holder.

The substrate may embrace the reliefs of the roller, for example being moulded onto the roller. In one variant, there is a space between the substrate and the roller, especially at the time of printing. During the transfer, the substrate is plated against the roller and the transfer surface is deformed to coincide with the relief of the area to be made up.

The roller may have the form of a right cylinder. In one variant, the roller has the form of an irregular cylinder, for example the form of an hour glass.

In one variant, the roller is "premoulded", i.e. it has an initial non-flat form corresponding to the general form of the area to be made up, for example the negative of the lips, of an eye socket, of an ankle or of a forearm.

The roller may comprise a holding system, especially a handle to be housed removably in the printer at the time of printing. The holding system thus serves to hold the roller at least during its positioning for the printing and, in a preferred variant, also during the transfer.

The handle comprises, for example, two symmetrical jaws configured so as to be assembled at the two ends of a roller.

The handle may comprise a device for indexing and/or blocking the rotation of the roller.

Preferably, the holding system is removable. The holding system is in particular arranged so as to be able to be used with several rollers.

The roller may be heated.

The roller may be filled.

In one variant, the roller is hollow and in particular arranged to house a heating element.

According to yet another of its aspects, a subject of the present invention is a pad holder intended to be used with a printer according to the invention.

The pad holder is arranged to carry at least one pad bearing a substrate with a transfer surface, in particular intended to come into contact with the keratin materials.

The pad holder may carry a single pad.

The pad holder may be arranged to carry simultaneously several pads; the pad holder may especially carry between 1 and 5 pads, for example 3 pads.

A pad may thus correspond to a cylinder part, for example defined by an angle of between 10° and 210°. The cylinder part is especially between 1/10 and 4/5 of a cylinder, in particular between 1/5 and 3/4 of a cylinder, or may even correspond to a quarter-cylinder or a half-cylinder.

In one variant, the substrate attached to the pad is premoulded, for example for producing transfer makeup on an eyelid.

The pad may comprise a holding system, to be housed removably with the pad(s) in the printer at the time of printing.

The system for holding the pad holder is preferably removable. It may be identical to the holding system described above. In particular, it may be used, without preference, with a roller or with a pad holder according to the invention.

In one variant, the transfer is performed by positioning, without rolling, the substrate on the keratin materials, a direct manual pressure on the outer face, opposite the transfer surface, then facilitating the makeup application by transfer of the cosmetic ink.

In one variant, to facilitate the adaptation of the transfer surface to the relief of the area to be made up, after the printing of step a) and before step b) of placing the transfer surface in contact with the area to be made up, the substrate is plated against an imprint forming part of the support by the action of deformation means.

The form of the imprint may correspond to the area of the keratin materials to be made up. The substrate is then deformable between:

- a first configuration in which the substrate is attached to the support and defines with the imprint a space, and
- a second configuration, known as the transfer configuration, in which the said substrate is plated onto the imprint under the action of deformation means.

The substrate thus passes from the first configuration, in which it has a regular transfer surface, which is especially flat or axisymmetric and readily printable, to the second configuration, in which the substrate may be modelled so as to take the form of the keratin materials to be made up.

The first configuration may or may not correspond to a printing configuration.

The substrate is preferably reversibly deformable between the first and the second configuration, the reversibility preferably being ensured by the intrinsic elasticity of the substrate.

In the second configuration, the relief of the support may correspond to the relief of the area to be made up, thus forming a counter-mould of the said area. The process may comprise a preliminary step of making the imprint. The imprint may especially be made by direct moulding of the area to be made up or using such a moulding, indirectly, for example using an intermediary mould.

The moulding is made, for example, of plaster, in particular with plastered strips, with alginate or with silicone.

In one variant, the imprint is made using a 3D printer, for example, by processing data regarding the relief of the area to be made up, for example stereoscopic images thereof; these images may comprise a fringe projection. This embodiment is particularly advantageous for the areas for which it is difficult to take a direct imprint, especially the area of the eye.

The imprint may be set and may correspond, for example, to a particular body area of a given user.

In another embodiment example, the imprint is variable, which makes it possible to change at will the form that the substrate will take for the transfer.

The support may comprise a system for varying the form of the imprint, making it possible to modify its form especially by means of at least one actuator, in particular in the context of a computer-assisted system.

The system for varying the form of the imprint may comprise actuators of any type. This system comprises, for example, an assembly of several mobile pins, especially between 10 and 4096 pins, or even between 64 and 4096 pins, which can be controlled by moving independently of each other.

In the first configuration, the transfer surface is, for example, flat or domed. In a preferential variant, the transfer surface is "premoulded", i.e. it has an initial non-flat form corresponding to the general form of the area to be made up, for example the negative of the lips, of an eye socket, of an ankle or of a forearm.

The space between the substrate and the imprint, which extends especially between the face of the substrate opposite the transfer surface and the imprint, may be filled with a fluid, for example compressed or non-compressed air, or a liquid.

A fluid is, for example, injected into the space between the imprint and the substrate to create an excess pressure during printing. The substrate appears swollen. In such an example, the substrate is preferably premoulded.

In the second configuration, the substrate is plated onto the imprint following a mechanical action of the deformation means.

Preferably, the mechanical action is effected without contact with the transfer surface. The deformation means may exert a force on the face of the substrate opposite the transfer surface.

The deformation means may be pneumatic or hydraulic.

The deformation means may also be arranged to create a negative pressure by suction. The deformation means comprise, for example, suction means for emptying the above-mentioned space.

The process may also comprise a step of finishing a pattern formed by at least one ink borne by the transfer surface. This pattern finishing step may be performed, for example, with the fingers or a special tool. For example, a pressure is applied to certain areas or certain areas are heated.

Once the ink has been transferred onto the keratin materials, the transfer surface is moved away from the area of the said materials and the substrate is then preferably removed from the support, if any.

The deformation means may be reversible and facilitate the detachment of the substrate outside the support, in particular to facilitate cleaning after transfer onto the keratin materials.

The process may also comprise a step of finishing the makeup obtained on the keratin materials, for example so as to attenuate the demarcations between a first area made up with a first ink and a second area that is not made up or that is made up with a second ink. The makeup finishing step is performed, for example, by exerting a friction on all or part of the transferred pattern.

Device

According to another of its aspects, a subject of the present invention is a cosmetic device for making up human keratin materials via a process according to the invention as described previously, the device comprising:

- a deformable substrate defining a transfer surface, intended to receive a cosmetic ink to be transferred by contact with the keratin materials,
- a support at least partly located opposite the transfer surface, to which is attached the substrate and against which the substrate bears at least during the transfer of the cosmetic ink onto the keratin materials,
- a system for holding the support on a digital printer.

The device may comprise a substrate and/or a support as described above.

By means of the device holding system, the support may or may not be totally assembled with the printer at the time of printing on the transfer surface.

The holding system may or may not be integral with the support during the transfer onto the keratin materials.

The support may be at least partly assembled with the printer during the deposition of ink by printing.

The holding system may be configured to combine all or part of the support with the printer by attaching it to the printer or by introducing it into the printer. The holding system may be configured to assemble the printer with at least one support frame, the substrate being attached to the frame, especially taut.

The frame may be of elongated form, for example rectangular.

The device may comprise a removable part, known as the "substrate holder" in the context of the invention, which is present at least at the time of deposition of the ink onto the transfer surface, to support the substrate and thus facilitate precise printing of the pattern.

Preferably, the support with the imprint is integral with the substrate at the time of printing and the holding system is configured to assemble the whole device with the printer.

The substrate holder may serve for the printing and may be removed, manually or automatically, after printing.

The substrate holder is, for example, a roller whose axle protrudes on each side so as to be able to slide the roller along two runners of the frame and bring it towards the printing area.

In some embodiment examples, only part of the device is assembled with the printer. For example, only the substrate, the frame and the substrate holder, if any, are attached to the printer during printing, and are subsequently separated from the printer and attached to a support imprint.

The transfer surface may embrace the form of the substrate holder, and may in particular be flat or domed at the time of printing and may subsequently be deformed with the substrate under the action of deformation means.

During the printing step, the substrate is supported, for example, by a substrate holder in the form of a plate, which is removed before the step of transferring the makeup onto the keratin materials.

In one variant, the support directly supports the substrate with sufficient dimensional stability during the deposition of the ink, without the need for a substrate holder.

In one variant, especially when a fluid is injected into the space between the printer and the substrate, as explained later, so as to create an excess pressure sufficient to support the substrate at the time of printing, a "substrate holder" is not necessary.

Advantageously, the substrate is reusable. Thus, after use, the transfer surface may be cleaned. The transfer surface may be cleaned while the substrate is or is not removed from the support. Preferably, the substrate is removed from the support and the substrate holder for cleaning in order to take advantage of the flexibility of the substrate, and the substrate may then be reintegrated into the device, which is ready for printing again.

The device may comprise a coat of at least one cosmetic ink deposited onto the transfer surface.

The colouring ink present on the device just before transferring may be not entirely dry. The application of a colouring ink that is not entirely dry onto the keratin materials facilitates the transfer of the ink.

The device may comprise a heating member, in particular to fluidize the coat of colouring ink and to facilitate its transfer onto the keratin materials.

In one embodiment example, the device, in particular the substrate, comprises an indication printed or not with the same ink as that intended to be transferred. The indication states, for example, the nature of the keratin materials intended to be made up with the colouring ink or illustrates to scale, enlarged, reduced or otherwise and "right-side up" the pattern deposited "wrong-side up" on the substrate.

The device may also comprise a handling member enabling it to be held and to facilitate the contact of the transfer surface with the keratin materials during the transfer of the ink.

Assemblies

According to another of its aspects, the present invention relates to a cosmetic assembly comprising, in the same packaging, a plurality of devices according to the invention as defined above.

The devices of the assembly may or may not comprise a colouring ink, deposited onto their transfer surface.

The devices may differ by the form of the support, especially of the imprint.

The devices may differ by the form and/or the composition of the substrate, in particular the transfer surface intended to engage with the keratin materials.

The devices may differ by the chemical nature of the colouring ink that they bear and/or by the pattern thereby formed.

According to yet another of its aspects, the present invention relates to a cosmetic assembly comprising, in the same packaging, one or more devices as defined previously, and at least one from among a colouring ink cartridge and deformation means for plating the substrate of a device onto an imprint.

The assembly may comprise several ink cartridges and substrate deformation means.

The assembly may also comprise a suitable printer.

Printer

According to yet another of its aspects, a subject of the present invention is a digital printer configured to deposit by printing a cosmetic ink onto a transfer surface of a device according to the invention.

The term "digital printer" means a machine for printing in the form of pixels using digital data, different from a machine comprising a printing form. The printer may be an inkjet printer, for example a thermal or piezoelectric printer, a sublimation printer or a laser printer.

In one example, the printer is a laser printer arranged to allow the formation by electrophotography or magnetophotography of a coat of ink having a pattern on a transfer surface using at least one cosmetic toner and to deliver the toner present on the transfer surface in a state that is sufficiently free to allow it to be taken up or transferred by contact with the human keratin materials.

The term "cosmetic toner" should be understood as meaning a pulverulent cosmetic composition that is compatible with the formation of an image via an electrophotographic or magnetophotographic process as used in laser printers. Preferably, it is a toner that is suitable for electrophotographic use.

The toner is cosmetic in the sense that it is compatible with an application to human keratin materials. Depending on the surface to be made up, the formulation of the toner may be different. For example, for an application to the hair or the nails, it is possible to use certain compounds that might not be used for an application to the lips, for example.

The printer may be a food-grade inkjet printer such as the Gatocopy A426 machine allowing printing onto non-flat objects.

The use of such a printer is particularly suited to certain embodiment examples as described above and in particular makes it possible to print onto a "premoulded" substrate or directly onto a device with an imprint, the printing nozzles being, for example, at a distance from the transfer surface of between 0.1 mm and 5 mm and preferably between 0.1 mm and 2 mm.

The printer may comprise a receptacle configured to co-operate with the holding system of a device according to the invention.

The printer may advantageously comprise means for rotating a roller and/or a pad support, referred to hereinbelow as "roller drive means".

The roller drive means may comprise gears configured to synchronize the rotation of the roller with the sweeping of the printing nozzles.

The printer may comprise feet, especially adjustable feet, to avoid friction when the roller drive means rotate the roller or the pad(s) borne by the pad holder.

The printer may comprise a receptacle to house, at least at the time of printing, a roller or a pad holder bearing at least one pad.

The receptacle may make it possible to removably house the roller or the support pad.

The receptacle may comprise at least one runner for inserting and removing the roller or the pad holder by guiding them. By means of the runners, once the roller or the pad holder has been inserted in the runners, the transfer surface comes close to the printing nozzles.

The printer may comprise a roller or a pad support, which are, for example, removable, especially to facilitate the cleaning of the transfer surface and to make it possible to select the use of a pad holder or a roller from an available range.

In one variant, the printer comprises a window for access to the transfer surface and transfer of the ink is possible while the substrate is present in the printer.

The printing width is, for example, between 0.2 and 40 cm, preferably between 5 and 200 mm, especially between 10 and 120 mm, better still between 10 and 80 mm, or even between 10 and 60 mm.

Preferentially, the printer comprises at least one cosmetic ink cartridge. The printer may comprise several cartridges, especially several cartridges of different colours.

BRIEF DESCRIPTION OF THE DRAWRINGS

Figure 2A:
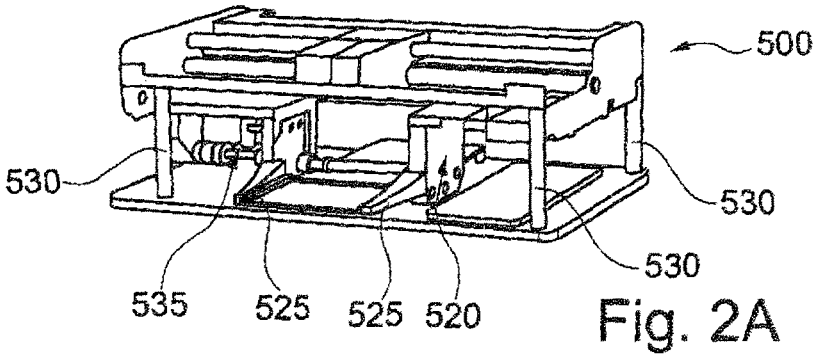
Figure 2B:
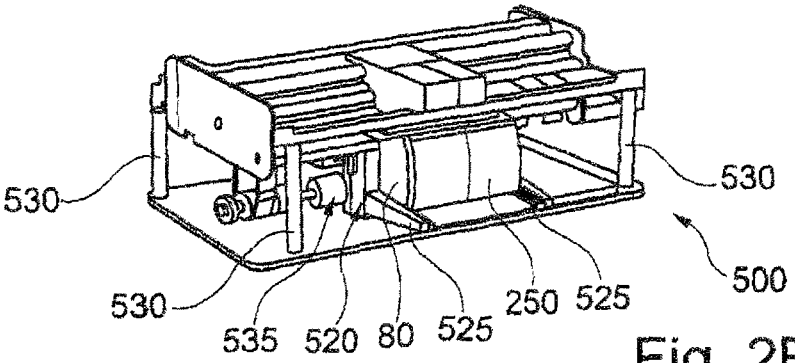
Figure 3:
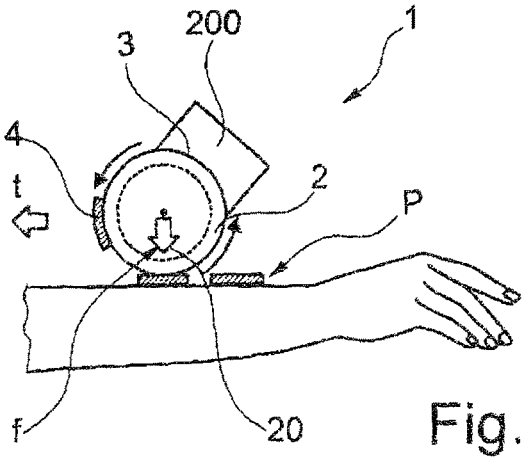
Figure 4:
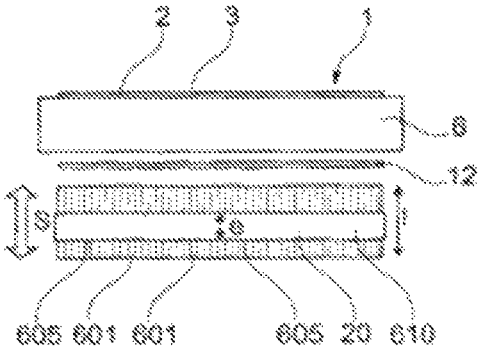
Figure 5A:
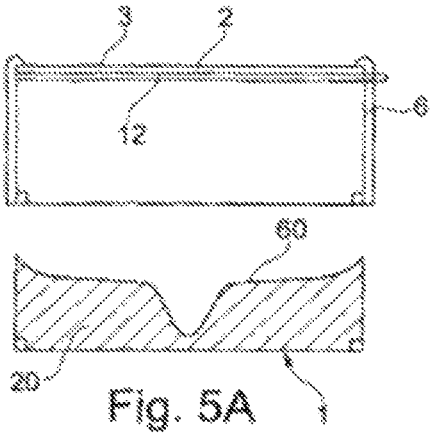
Figure 5B:
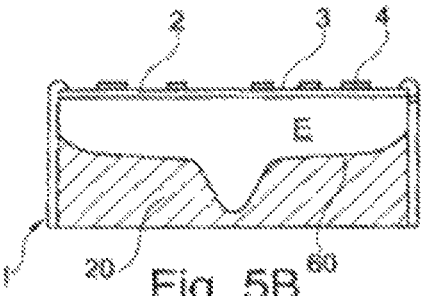
Figure 5C:
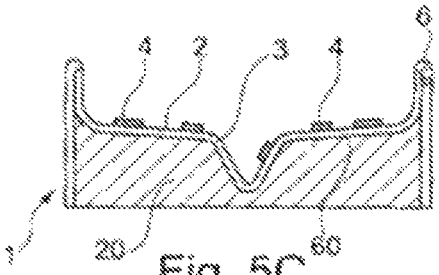
Figure 5D:
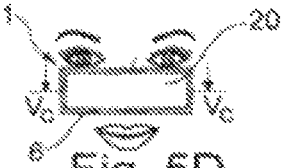
Figure 5E:
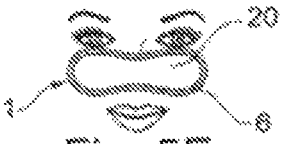
Figure 5F:
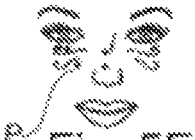
Figure 6:
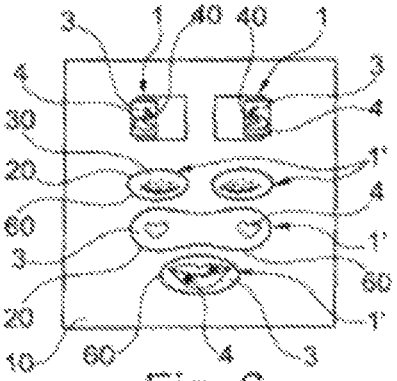
Figure 7:
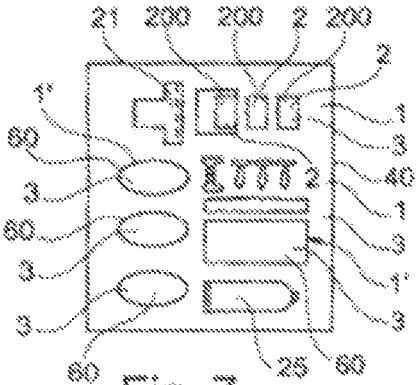
Figure 8:
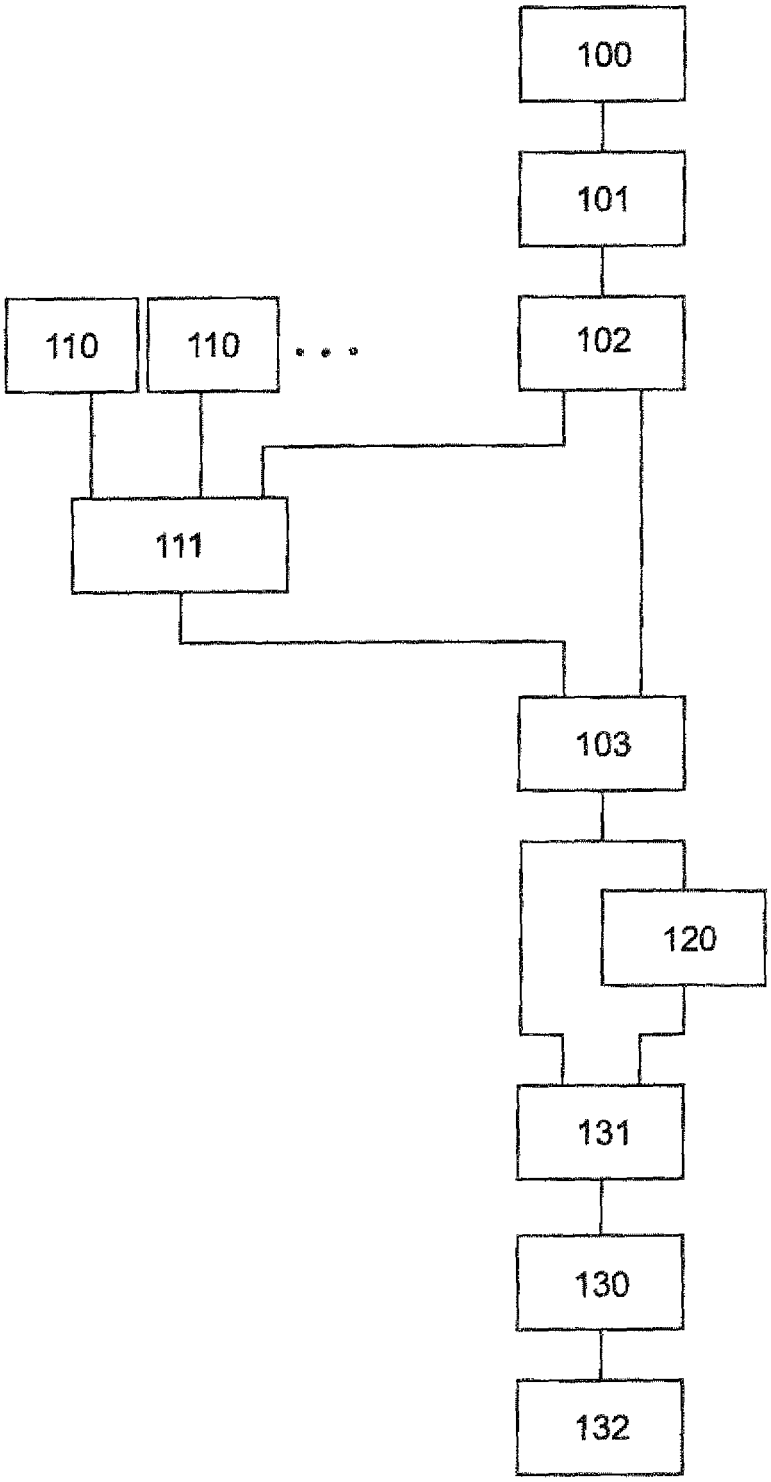
Figure 9A:
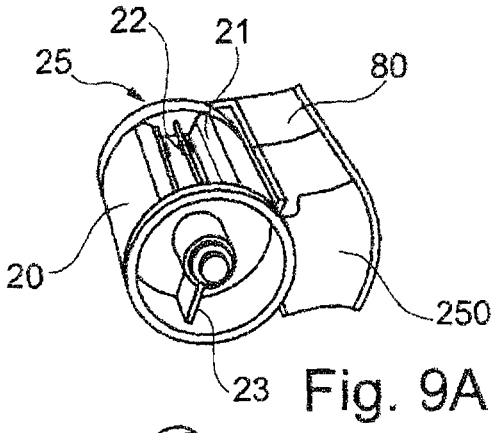
Figure 9B:
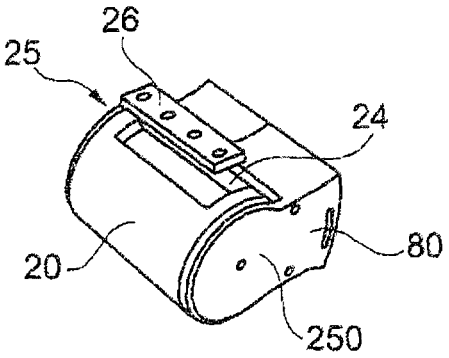
Figure 9C:
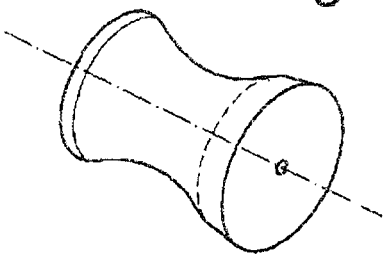
Figure 10A:
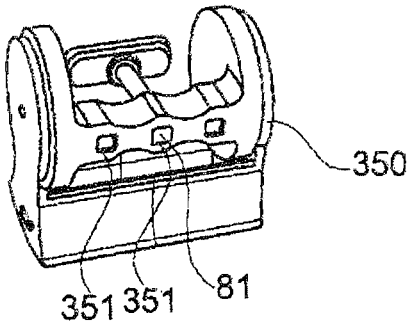
Figure 10B:
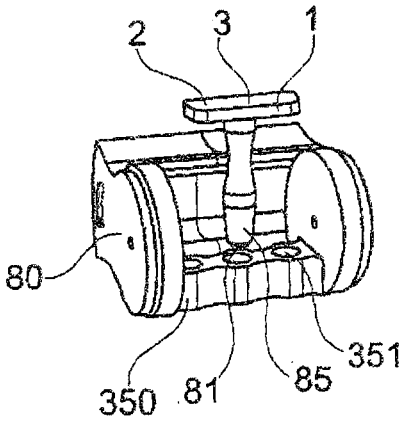
Figure 10C:
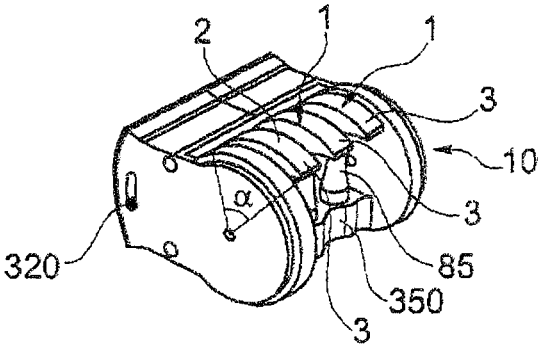
Figure 10D:
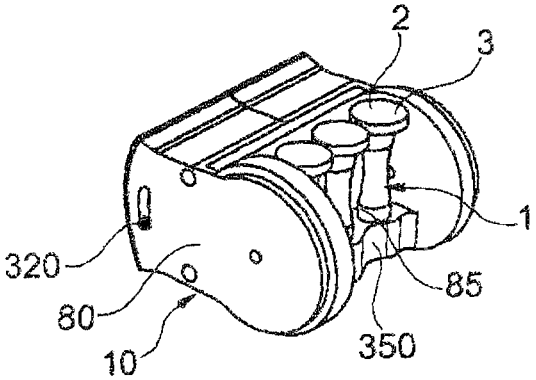
Figure 11:
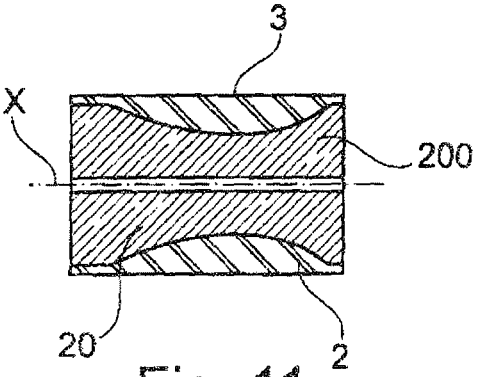

The invention may be understood more clearly on reading the following description of non-limiting implementation examples thereof, and on examining the attached drawing, in which:

FIG. 1A represents, in perspective and in elevation, an example of a makeup device according to the invention, FIG. 1B represents, in perspective and in elevation, an example of a makeup device according to the invention, FIG. 1C represents, in perspective and in elevation, an example of a makeup device according to the invention, FIG. 2A represents the device of FIGS. 1A-1C and a suitable printer, FIG. 2B represents the device of FIGS. 1A-1C and a suitable printer, FIG. 3 illustrates a makeup process according to the invention, using the device of FIGS. 1A-1C, FIG. 4 is an exploded view of one variant of the makeup device according to the invention, FIG. 5A illustrates different steps of a makeup process according to the invention, FIG. 5B illustrates different steps of a makeup process according to the invention, FIG. 5C illustrates different steps of a makeup process according to the invention FIG. 5D illustrates different steps of a makeup process according to the invention, FIG. SE illustrates different steps of a makeup process according to the invention, FIG. 5F illustrates different steps of a makeup process according to the invention, FIG. 6 represents an example of cosmetic assemblies according to the invention, FIG. 7 represents an example of cosmetic assemblies according to the invention, FIG. 8 is a block diagram illustrating various steps of a makeup process according to the invention, FIG. 9A shows in elevation another example of a device according to the invention before attaching the substrate, FIG. 9B shows in elevation another example of a device according to the invention before attaching the substrate, FIG. 9C shows in elevation another example of a device according to the invention before attaching the substate, FIG. 10A shows in elevation a variant of a device according to the invention, FIG. 10B shows in elevation a variant of a device according to the invention, FIG. 10C shows in elevation a variant of a device according to the invention, FIG. 10D shows in elevation a variant of a device according to the invention, and FIG. 11 is a partial view in cross section of a variant of a device according to the invention.

DETAILED DESCRIPTION

FIG. 1A shows a makeup device 1 according to the invention, comprising a substrate 2 defining a transfer surface 3.

The substrate 2 is made of a flexible, compressible and deformable material.

The substrate 2 consists in the illustrated example of a printing blanket made of elastomeric material, plated onto a support 20 in the form of a hollow roller 200 to which it is attached by simple friction.

The transfer surface 3 is smooth and has a roughness of less than or equal to 50 μm measured using a roughness meter as described above.

The transfer surface 3 constitutes the outer surface intended to receive a coat of cosmetic colouring ink 4, to perform a transfer makeup application.

To deposit the coat of colouring ink 4 onto the transfer surface 3, use is made of a digital printer 500 shown in FIGS. 2A and 2B, which deposits the ink dots in correspondence with the pixels of an image to be reproduced.

As illustrated in FIG. 1B, a removable handle 80 may be made integral with the support 20 to serve as a handling member for holding the device during the transfer of makeup.

It is advantageous for the handling member 80 to be removable; thus, it may be removed as illustrated in FIG. 1A to allow the substrate 2 to be plated more easily onto the support 20 and to clean it between two uses. The handle 80 comprises, in the example under consideration, two plastic jaws made of POM produced by machining, which are intended to be assembled with the ends of the support 20 in the form of a roller.

In the example under consideration, the handling member constitutes the holding system 250 used during printing. As a variant, the holding system is different.

As illustrated in FIGS. 2A and 2B, during printing, the device 1 is assembled with the printer 500 by means of the co-operation of a holding system 250 of the device 1 with a receptacle 520 of the printer 500, allowing, for example, click-fastening of the applicator roller onto the printer 500.

In these figures, the outer case of the printer 500 has been removed in order to illustrate the integration of a device according to the invention. Whereas FIG. 2A shows the receptacle 520 in the absence of a device, FIG. 2B shows the printer 500 housing the device 1. The roller is not visible in the figure.

In one variant, a pad holder bearing, for example, three pads has been assembled with the handle 80. The receptacle 520 comprises, for example, two runners 525 for receiving and guiding the handle 80 assembled with the roller or with the pad holder and thus for facilitating their insertion in and their removal from the receptacle 520. The transfer surface 3 is thus placed close to the printing nozzles to allow good precision of the pattern formed by the coat of ink 4. The distance between the nozzles and the transfer surface is, for example, between 0.5 mm and 1.5 mm.

The printer 500 also comprises roller drive means 535 comprising gears configured to make the substrate 2 pass through at the time of printing and to synchronize the rotation of the roller 200 with the sweeping of the printing nozzles.

The roller drive means 535 are, for example, at least partly located in a flange to the left of the receptacle 520.

The printer also comprises four feet 530, for example adjustable feet, for preventing, during the printing, friction of the roller or of the pad(s) borne by the pad holder and driven in rotation.

FIG. 1C represents the device 1 once removed from the printer 500, the transfer surface 3 bearing a coat of cosmetic ink 4.

A pattern 40 representing in negative the image to be reproduced is printed directly onto the transfer surface 3 using the printer 500.

The coat of ink 4 may form any type of pattern. The pattern may consist of several inks.

The substrate 2 may bear information 7, for example formed by printing, for giving advice regarding the recommended positioning for applying the makeup, or for informing as regards the nature of the keratin materials intended to be made up by the ink 4 or the like.

The device 1 may also comprise a heating member, not shown, for example located inside the support 20.

FIG. 3 schematically shows an example of a makeup process according to the invention.

The roller 200 of FIGS. 1A-C, once the printing has been performed, is, for example, taken out of the receptacle 520.

The transfer makeup may be performed just after printing or within 30 minutes thereof, but also within a few days, or even a few months after printing.

By holding the handle 80, the user brings the roller 200 close to the keratin materials so as to place in contact, as illustrated, the coat of colouring ink 4 with the area P to be made up, the forearm in the illustrated example, which is preferably dry, and the user then rolls the transfer surface 3 while applying a pressure allowing the colouring ink 4 to be transferred onto the area to be made up P. As illustrated by the arrow f, the pressure is applied by means of the support 20 on the face of the substrate opposite the transfer surface 3.

During contact with the keratin materials, the roller 200 advances in the direction of the arrow t and the substrate 2 is preferably not moved sideways so as not to affect the appearance of the transferred pattern.

The pattern transferred onto the keratin materials corresponds in positive to the pattern 40 formed in negative by the coat of colouring ink 4 when it is present on the substrate 2 (i.e. when it has not yet been transferred onto the keratin materials to be made up) and faithfully reproduces the starting image.

FIG. 4 illustrates a device 1 according to a second embodiment of the invention.

The device 1 comprises an elastically deformable and compressible substrate 2 comprising a smooth transfer surface 3, configured to receive a coat of cosmetic ink 4 and which may be attached to a support 20 via a frame 6.

The device 1 also comprises a removable substrate holder 12 which provides the stability and holding of the substrate at least during the deposition of the coat of cosmetic ink 4.

The substrate holder may be made of a rigid or semi-rigid material. The substrate holder may comprise a flexible plate. The support 20 may be configured to form an imprint 60 of the area of the keratin materials to be made up.

The support 20 may be transformable and adaptable to the relief of an area P of human keratin materials to be made up to form a suitable imprint.

In the illustrated example, the support 20 comprises a plurality of pins 601 that are mobile according to the double arrow S, for example between 10 and 500 pins, better still between 100 and 500 pins, each arranged in a hole 605 of a guide 610 which may be flexible or hard. Small pins are placed in each of the holes. The length of the pins is greater than the thickness of the guide.

The system is equipped with a means for preventing the pins from coming out of the hole, without preventing the pins from moving. For example, another membrane that blocks of the exit of the pins may be placed on the rear face, or alternatively each pin is retained by an elastic zone, or alternatively each pin has one or two stubs that limit the movement beyond a certain course. The mobile pins may be moved individually or as a group by simple mechanical pressure, in particular during the taking of an imprint directly on the area to be made up.

In one variant, the mobile pins may be moved by hydraulic pressure, or by electromagnetic or electrostatic force, especially when direct moulding is not possible or desired. The mobile pins are moved, for example, via a system of actuators.

The support may comprise a system for blocking the pins, at least temporarily, after taking the imprint, so that they do not move before the ink has been transferred. This system may use a mechanical force or an electromagnetic or electrostatic force. This system may be a braking system which is deactivated to move the pins and which is activated to block them.

Preferably, the presence of friction between the pins is such that the force exerted on the ends of the pins during the plating of the substrate or during the transfer is insufficient to move the pins.

The pins thus come into contact with the substrate during the plating and then give it protruding reliefs and hollows by pressure.

In one variant, not shown, the support also comprises a flexible membrane above the group of pins so that the pins do not come into contact with the keratin materials during the taking of the imprint.

In one variant, not shown, the support comprises an outer surface formed from a mobile membrane and a system of actuators, especially of jacks, configured to deform the mobile surface and/or to hold it in a position corresponding to the reliefs of the keratin materials especially after direct taking of the imprint or image processing. Each jack may be moved by means of an electromagnet or by a pneumatic or hydraulic force.

In another variant, as illustrated in FIGS. 5A-E, the support comprises an imprint of set form 60.

The imprint 60 is made, especially of rigid or semi-rigid thermoplastic material, using a 3D printer or by direct moulding of the area to be made up, for example with plaster, alginate or silicone. A substrate 2 is then attached via a frame 6 onto the support 20 and the device 1 is assembled with a printer to deposit a coat of ink 4 onto the transfer surface 3.

During printing, the transfer surface is flat and held in position by means of a substrate holder 12.

FIG. 5B shows the device after printing, once separated from the printer. In a first configuration, the device has a space E filled with air between the imprint 60 and the face of the elastomeric substrate 2 opposite the transfer surface 3. The substrate 2 has a flat transfer surface 3 at the time of printing.

In one variant, the space E is filled with compressed air or with another fluid and the transfer surface has a domed appearance comparable to an inner tube. The substrate holder 12 is then removed, for example manually, and the air present in the space E is sucked out via deformation means 25, not shown.

The substrate 2 is thus deformable between the first configuration and a second configuration corresponding to the transfer of the ink onto the area to be made up, in which the substrate 2 is thus plated against the imprint 60 and the transfer surface takes the form of the area P to be made up as illustrated in FIG. 5C.

The device is then brought close to the keratin materials to place the transfer surface 3 in contact with the area P to be made up. FIG. 5D illustrates the placing in contact of the device 1 comprising a frame 6 of rectangular section with the cheeks and the nose. The device of FIG. 5E differs from that of FIG. 5D by its form.

FIG. 5F shows the transferred makeup as indicated by ** on wearer's nose and the area underneather the wearer's eyes immediately adjacent to the wearer's nose (P). The invention allows precise, reproducible makeup application, the makeup being easy to apply despite its complexity.

The support 20 bearing the substrate 2 and the support holder 12 is assembled with a printer of food-grade inkjet printer type for printing onto non-flat objects to print a coat 4 that reproduces a pattern of cosmetic ink on the transfer surface.

In the illustrated variant, the frame 12 serves both for attaching the substrate 2 to the support 20 and as a system 250 for holding the device 1 with the printer 500.

In one variant, only the frame 6 with the substrate 2 and the substrate holder 12 is configured to be assembled with a printer, for example introduced into a printer 500.

FIG. 6 shows an embodiment example of a cosmetic assembly 10 according to the invention. This assembly comprises, in the same packaging, a plurality of devices 1 and 1' according to the invention which differ by the type or form of the support 2.

In the illustrated example, each of the devices comprises on its transfer surface 3 a coat of colouring ink 4 forming a negative pattern 40 relative to the desired pattern.

The packaging may be leaktight so as to prevent the inks from drying out. The packaging may be made with means for avoiding contact of the inks with a surface other than the transfer surface, so as to reduce the risk of premature transfer. For example, the packaging comprises a thermoformed shell whose wall extends a distance from the transfer surfaces covered with inks.

In addition, the devices 1' comprising an imprint 60 are packaged, for example, in their second configuration, the substrate 2 being plated onto the imprint 60.

FIG. 7 shows an embodiment, which is a variant of a cosmetic assembly 10 shown FIG. 6, according to the invention that comprises a plurality of devices 1 and 1' according to the invention, differing by the type or form of the support 20.

A first device 1 comprises a substrate 2 with a transfer surface 3 intended to be printed with the colouring ink, the substrate 2 being plated onto a support 2 in the form of a roller 200 and a handle 80 also serving as a holding means 250.

The assembly 10 comprises, for example, a plurality of rollers 200 and a pad holder 350 according to the invention. A first roller 200 is, for example, assembled with a handle 80 which may serve as a system 250 for holding on a printer as seen above.

The cosmetic assembly 10 comprises several rollers 200 arranged to bear substrates 2 of different thicknesses. All the rollers and 200 of the assembly have the same diameter, measured with the substrate attached to the roller. Each diameter of empty roller 200, i.e. before attaching the substrate, corresponds to a thickness e of substrate such that the transfer surface of the device defines a cylinder of diameter, in particular 60 mm in diameter.

As illustrated in FIG. 11, the thickness e and the diameter may vary along the longitudinal axis of the roller.

Each roller 200 comprises a substrate 2 with a transfer surface 3 intended to be printed with the colouring ink, the substrate 2 especially being plated onto the roller.

The cosmetic assembly 10 also comprises a pad support 350 that can be adapted to the holding means 250 and also several pads 300 and a strip of elastomeric film to be cut and bonded as substrate onto the pads.

Several devices 1' comprise an imprint 60 corresponding to different areas to be made up.

The devices do not comprise any coat of ink and the cosmetic assembly 10 comprises, in the same packaging, a printer cartridge 21 comprising one or more cosmetic colouring inks intended to be deposited onto the transfer surfaces 3 and deformation means 25 for plating the substrates 2 onto the imprints 60. In one variant, not shown, the assembly comprises several cartridges, containing, for example, different inks.

This cosmetic assembly may be provided to the user, where appropriate, with the printer intended to use the cartridge.

An example of a makeup process according to the invention will now be described, with reference to FIG. 8.

The process may comprise a step 111 of selecting a device suited to the area to be made up and to the pattern, chosen from a range of devices according to the invention.

When the area P to be made up bears reliefs, the device 1 used preferably comprises an imprint 60 corresponding to the said reliefs.

A makeup process according to the invention may thus comprise a preliminary step 110 of making the imprint.

The imprint 60 is made during step 110, for example by moulding directly onto the area P of the keratin materials or by 3D printing and image processing. In one variant, the imprint 60 is set and intended to be used several times, especially for a precise area of the keratin materials of a particular user.

In another variant, the imprint may be modified and customized before each transfer makeup application and may thus be adapted in a very modular manner to a change of user and/or of area to be made up.

The process comprises the printing of a pattern to be transferred, and may also comprise steps 100 to 103 of choosing the pattern.

In a first step 100, various patterns are proposed to the user, for example by displaying on the screen of a machine.

The range of patterns proposed may correspond to several areas of makeup requiring several different transfer devices.

Step 101 of choosing the pattern by the user may comprise an action such as pressing on a touchscreen in order to select the pattern intended to be printed.

The machine may also provide the user with a simulation of the makeup result. Thus, the machine may display a simulation of the appearance of the keratin materials made up with the chosen or produced pattern. To do this, the machine may acquire at least one image of the keratin materials to be made up.

In one variant, the user makes a computer file with the pattern that he wishes to print. In this case, the user may use drawing software for making such a pattern, and edit it, for example, in a file in .jpg image format.

Once the pattern has been chosen or made, in step 102, the machine sends to the printer the data necessary for printing the pattern, and in particular states the device to be used. This device may comprise an imprint specially made following the area to be made up during step 110 or selected from a range of devices during step 111.

The device is then in step 103, at least partly, assembled with the printer. Depending on the device selected, all or part of the device is assembled with the printer by means of a holding system, for example the substrate and the substrate holder are attached to the printer.

In one variant, only the frame, the substrate and the substrate holder are attached to the printer.

The machine may be connected physically and/or by means of a network to the printer performing the printing.

Once the data have been received and the support, or even the whole device, has been assembled with the printer, in step 103 the pattern is printed in negative on the transfer surface while the device is at least partly assembled with the printer. FIGS. 1C and 5B illustrate patterns thus printed onto the transfer surface of different types of device according to the invention.

The printer driver may comprise a menu for selecting a cosmetic ink cartridge among other cartridges installed in the printer and/or the nature of the substrate that is printed. As a variant, the printer automatically recognizes that the cartridge installed is a cosmetic ink and adjusts the operating parameters in consequence. The cartridge may thus comprise an identifier, for example an electronic chip, for providing the printer with information relating to the nature of the colouring ink that it contains, especially that this ink is of cosmetic nature.

In one embodiment example, the printer is configured to prohibit printing if the assembled device does not correspond to the chosen pattern and/or if the presence of a cartridge comprising a composition not intended to be placed in contact with human keratin materials, especially the skin, the nails or the lips, is detected.

As a variant, the printer may perform printing even if the presence of a cartridge comprising a composition not intended to be placed in contact with human keratin materials, especially the skin, the nails or the lips, is detected, this non-cosmetic ink cartridge possibly being used for printing on the substrate an indication 7 relating to the cosmetic colouring ink borne by the transfer surface and/or the nature of the keratin materials to be made up.

The printing of the substrate may take place in several passes, to make successive deposits of ink at the same place, so as to increase the amount of ink deposited on the substrate. The substrate may effect, for example, between 1 and 20 passes in the printer and the amount of cosmetic ink dry matter deposited ranges, for example, from 0.1 $mg/cm^2$ to 10 $mg/cm^2$ and better still from 0.2 $mg/cm^2$ to 5 $mg/cm^2$.

The pattern may be monochromatic or, better still, polychromatic. In this case, printing may be performed at each passage in the printer with several cosmetic inks that are locally juxtaposed at the microscopic scale, depending on the colour to be reproduced.

The printing resolution may be between 16 dpi and 2048 dpi.

In a manner known to those skilled in the art, the printer may be arranged to detect if the ink previously deposited on the substrate is sufficiently dry before printing a new coat of ink.

The printer and/or the printer driver may be made so as to inform the user of the need to wait a predefined time before performing a new printing on the already-printed substrate. The printer and/or the driver may automatically suspend the printing of an already-printed substrate if sufficient time has not passed to allow sufficient drying. The printer is preferably arranged so as not to deliver the printed substrate as long as all the coats of ink to be printed have not been printed.

The device is then optionally separated from the printer in order for the ink to be able to be transferred onto the keratin materials.

In the case of printing performed on a substrate attached to a support that is not integrally attached to the rest of the device, during a step 104 the device is reassembled, and the frame is especially repositioned on the support.

For example, the substrate is attached to the support in a first configuration corresponding to FIG. 5B.

When a device embodiment with imprint 60 is used, before transferring the colouring ink onto the keratin materials, the substrate 2 is plated against the support 20 under the effect of a mechanical action of the deformation means during a step 120 to take a second configuration as illustrated, for example, in FIG. 5C.

The process may be commenced by removing any substrate holder 12 and/or a protective film that have not been removed before so as to preserve the stability of the printed pattern, especially up to the point of plating the substrate onto the imprint. Next, the substrate 2 is deformed under the action of deformation means 25, especially means 75 for suction of the fluid 25.

For a device 1 corresponding, for example, to an applicator roller such as that of FIGS. 1A-C, the plating of the substrate onto the support is performed before depositing the colouring ink onto the transfer surface 3. The substrate 2 is, in this embodiment, plated directly onto the support 20 and step 120 is superfluous.

Transfer then takes place during step 130 by simple contact of the transfer surface 3 with the keratin materials P, especially by rolling the device on the keratin materials in the case of a device in the form of a roller 200 as illustrated in FIG. 3, or application of the imprint 60 covered with the substrate 2 as in FIGS. 5D and 5E. The transfer is facilitated by pressing the device against the keratin materials during step 130.

Step 130 may be preceded by a step 131 of finishing the pattern on the transfer surface. This step of finishing the pattern deposited on the transfer surface may be performed with the fingers and/or a special tool or by means of a geometrical rectification system. For example, a pressure is applied to certain regions or certain regions are heated.

Step 130 may be followed by a step 132 of finishing the makeup application.

Step 130 may comprise heating of the device.

FIG. 9A illustrates a variant of the device according to the invention before attaching the substrate to the support. The illustrated device comprises a handle 80 similar to the handle of the system in FIGS. 1A to 1C. This handle 80 may be used with several different rollers 200, adapted to different thicknesses of substrate and different modes of attachment.

Whereas the substrate in the embodiment example of FIGS. 1A to 1C was attached by friction to the support, a device according to the invention may comprise a means 25 for attaching a printing substrate to the support 20.

The means 25 for attaching the printing substrate to the support illustrated in FIG. 9A comprise a groove 21 on the outer surface of the roller, a double clip 22 whose opening is driven by cams located at each end of the roller 200 and a system of springs, not shown, for keeping the double clip closed.

In the example illustrated in FIG. 9B, the means 25 for attaching the substrate to the roller comprise a fixing jaw 26 arranged to be attached, for example by screwing, in a housing 24 of the roller, holding the substrate in position.

The empty diameter of the roller 200 is chosen so as to correspond to the thickness of the substrate such that, once the substrate 2 is in position, the transfer surface 3 forms a cylinder of diameter D, for example equal to 60 mm.

FIGS. 10A to 10D illustrate a pad holder 350 intended to be assembled with a holding system 250, in particular with the handle 80.

These figures illustrate, for example, a pad holder 350 according to the invention which can simultaneously receive three pads.

A substrate 2 is bonded to the outer surface of each pad 300; the substrates 2 are, for example, cut out of an elastomeric film bonded to the support.

FIGS. 10A to 10D depict variants of FIGS. 9A-9C. In the examples of FIGS. 10A to 10D, a pad support 350 has been added to the handle 80 (explicitly depicted in FIGS. 10B and 10D) of a holding system (disclosed in FIGS. 9A and 9B) instead of a roller.

In one variant, not shown, a pad holder is configured to receive only one pad.

A pad support may receive, for example, between one and five pads.

Preferentially, the pad support 350 and the pads 300 are configured so that the transfer surfaces of the pads belong to a cylindrical envelope surface, in particular 60 mm in diameter.

FIGS. 10A to 10D illustrate various devices according to the invention comprising a support in the form of a pad. System 10 of FIG. 10A comprises only one device 1 in the form of a pad, shown here attached to the holding system. FIG. 10B shows the same system, the device in the form of a pad being isolated from the holding means. The device comprises a holding member 85 in the form of a sleeve terminating with a square end piece 81 allowing it to be attached in a housing 351 of the pad support 350.

The pads may correspond to a cylinder part, for example defined by an angle of between 20° and 210°. The cylinder part is especially between 1/10 and 4/5 of a cylinder, in particular between 1/5 and 3/4 of a cylinder, or may even correspond to a quarter-cylinder or a half-cylinder. Thus, the pad illustrated in FIGS. 10A and 10B has a transfer surface 3 of oblong and cylindrical form along its large axis, corresponding to an angle a of 10°.

FIG. 10C illustrates three pads whose transfer surface is a cylinder portion defining a quarter-cylinder. The pads shown in FIGS. 10A and 10B comprise an outer surface of oblong and cylindrical form along their large axis.

FIG. 10C shows three pads 3 whose outer surface is a cylinder portion.

The pads of FIG. 10C are of oblong and cylindrical form along their small axis.

The device variant of FIG. 10D comprises three pads 3 of spherical form.

In variants not shown, the outer surfaces of the pads 300 are flat.

In another example not shown, the substrate attached to the pad is premoulded. A substrate 2 is bonded to the outer surface of each pad 300; the substrates 2 are, for example, cut out of an elastomeric film bonded to the support.

The handle 80 may comprise a device 320 for blocking the rotation of the roller 200 or of the pad support 350.

EXAMPLES

Example 1

Sub-example 1*a*) (FIGS. 5C and 8)

In this example, the roller is filled, and in the form of an hour glass. The empty diameter at the centre is 20 mm smaller than at the ends.

An elastomeric silicone coating is moulded around this roller so as to give the roller a cylindrical form with a diameter equal to 60 mm.

The central part of the substrate is softer than the side parts, which makes this type of roller particularly suited to domed body areas such as the chin or the arms.

Example 1

Sub-example 1*b*) For Transfer Makeup Application on the Arms

An alginate composition was applied to an arm over a length of 20 cm and a width of 8 cm.

After setting solid, the imprint that has just been made is rolled up so as to make the two ends touch. A flexible object in the form of an hour glass is thereby obtained.

A mould is made from this object in two parts.

The two parts of the mould are opened to remove therefrom the flexible object made with the imprint.

A polymerizable resin composition is then introduced into the two parts of the mould, via a hole made therein.

After curing, the cast is removed from the mould. The process is then performed as in the preceding example by applying a flexible elastomeric composition so as to make a cylinder.

This roller is especially suitable for printing on the arm.

These examples correspond to the embodiment with a roller.

A Canon IP 100 printer is used:

The printer case was removed. While leaving the gears usually used for rotating the driving roller, the sheet driving roller system was replaced with a driving system arranged to rotate a support in the form of a printing roller in a synchronized manner relative to the sweeping of the printing nozzles.

The printing roller of Example 1 is filled and cylindrical with a diameter of 60 mm and a length of 80 mm. It is made of hard plastic of Delrin type and covered with a substrate 2 formed from a film of silicone elastomer 2 mm thick.

During printing, the printing roller is removably attached to the printer by means of a holding system as described above, to come close to the printing nozzles (distance of about a millimetre) and to obtain a satisfactory printing quality.

The sheet presence system was modified so as not to prevent the printing from functioning.

The body of the printer used has feet which allow it to be raised so as to ensure the free rotation of rollers of various sizes while at the same time avoiding its friction on a part of the printer.

After printing, the device is removed from the printer to bring it into contact with the area to be made up.

The roller of this example is particularly suited to relatively flat large surfaces such as the back.

Example 2

This example corresponds to the embodiment illustrated in FIGS. 1 to 3.

The support is a regular cylindrical applicator roller 5 cm in diameter onto which is plated a substrate in the form of a printing blanket 5 mm thick made from an elastomeric material, for example sold under the name Patsil® Gel 10 by the company Polytek.

The applicator roller is assembled with a Canon IP 100 printer adapted as described above to be able to print on such a roller.

After printing, the system is removed from the printer to bring it into contact with the area to be made up.

The transfer by contact of the roller is rapid, easy and precise, especially on the nails and the cheeks.

Example 3

This example corresponds to the embodiment illustrated in FIGS. 9C and 11.

In this example, the roller 200 is filled and is in the form of an hour glass with an empty diameter d 20 mm smaller in the middle of the roller than at the ends (diameter of 60 mm at the edges and 40 mm at the centre).

An elastomeric silicone coating is moulded around this roller so as to give the roller a cylindrical form with a diameter D equal to 60 mm.

The central part of the substrate is softer than the side parts, which makes this type of roller particularly suited to domed body areas such as the chin or the arms.

Example 4

An alginate composition was applied to a part of an arm to be made up, over a length of 20 cm and a width of 8 cm.

After setting solid, the alginate imprint that has just been made is rolled up so as to make the two ends touch. A flexible object in the form of an hour glass is thereby obtained, with which a mould is made in two parts. Next, a polymerizable resin composition is introduced via a hole between the two parts of the mould to make a roller in the form of an hour glass.

After curing, an object in the form of an hour glass is removed, which can serve as a support for a device in the form of a roller. The process is then performed as in the preceding example by plating an elastomeric substrate so as to make a roller that is specially adapted to transfer onto a part of the arm.

Example 5

A plaster imprint forming a counter-mould of the region of the eye is made.

The frame of a support bearing a substrate in the form of a printing blanket 2 mm thick, made, for example, of an elastomeric material, as used in Example 1, is then placed around the imprint.

The device is then assembled with a Gatocopy A426 food-grade inkjet printer equipped with a cartridge of cosmetic ink.

After printing, an internal substrate holder plate is removed (by unclipping the system which held the plate). Suction is then performed, which draws the substrate against the imprint, and the whole is applied to the region of the eye.

Air is then allowed to enter the system. The blanket resumes its original form and the substrate holder plate is reinserted.

A new print may then be performed.

Example 6

In accordance with the preceding example, a plaster imprint forming a counter-mould of the region of the eye is made, and the frame of a support bearing a substrate in the form of a printing blanket 2 mm thick made of an elastomeric material is then placed around the imprint.

In this variant, no substrate holder is used, but air is injected into the space between the imprint and the substrate, which creates an excess pressure making the substrate appear swollen. The device is then assembled with a Gatocopy A426 food-grade inkjet printer equipped with a cartridge of cosmetic ink.

Printing is performed on the transfer area. The excess pressure promotes the quality of the printing, the printer nozzles being located, for example, a distance from the transfer surface of between 2 mm and 5 mm.

After printing, the device is moved away from the printer and suction is then performed to draw the substrate against the imprint, and the whole is applied to the region of the eye. Transfer of the ink takes place by simple contact.

After transfer, the device is removed from the area of the keratin materials and air is then allowed to enter the system. The blanket may be easily removed for cleaning before reinserting it for a new print.

The characteristics of the various embodiment examples may be combined together, within variants that are not shown. The expression "comprising a" should be understood as being synonymous with "comprising at least one", unless specified to the contrary.

The invention claimed is:

1. A process for preparing a makeup device and for making up an area of human keratin materials using the makeup device, the process comprising:

a. providing a makeup device comprising a mold having an imprint surface contoured to correspond with the area of human keratin materials and a deformable substrate attached to the mold, wherein the imprint surface and deformable substrate are spaced apart from one another, the substrate bearing a transfer surface intended to come into contact with the area of human keratin materials, and depositing at least one cosmetic ink onto the transfer surface by means of at least one digital printer, b. after the cosmetic ink has been deposited onto the transfer surface, deforming the deformable substrate onto the contoured imprint surface of the mold under the action of a deformation tool such that the deformable substrate conforms to the contour of the imprint surface, the deformation tool being pneumatic, hydraulic, or arranged to create a negative pressure by suction, c. transferring the cosmetic ink to the area of human keratin materials by placing the transfer surface, while the deformable substrate is conformed to the contoured imprint surface, in contact with the area of human keratin materials to be made up by mechanical action, and d. moving the makeup device away from the area of human keratin materials after the cosmetic ink has been transferred.

2. The process according to claim 1, the substrate being elastically deformable.

3. The process according to claim 1, further comprising a preliminary step of making the imprint surface using a 3D printer or by direct molding of the area of human keratin materials.

4. The process according to claim 1, the makeup device being at least partly assembled with the printer during the printing step a).

5. The process according to claim 1, in which, during the printing step a), the substrate is supported by a removable substrate holder or directly supported by the support.

6. The process according to claim 1, further comprising a step of finishing a pattern formed by the cosmetic ink borne by the transfer surface prior to performing the transfer step c) and/or a step of finishing the cosmetic ink on the area of human keratin materials.

* * * * *